US006971567B1

(12) United States Patent
Cannaliato et al.

(10) Patent No.: US 6,971,567 B1
(45) Date of Patent: Dec. 6, 2005

(54) ELECTRONIC CONTROL OF A CORDLESS FASTENING TOOL

(75) Inventors: Michael F. Cannaliato, Bel Air, MD (US); Timothy W. French, Jr., Hampstead, MD (US); Christopher S. Pedicini, Nashville, TN (US); Terry L. Turner, Westminster, MD (US)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 10/978,869

(22) Filed: Oct. 29, 2004

(51) Int. Cl.[7] ..... B25C 1/06

(52) U.S. Cl. ..... 227/2; 227/131; 173/1; 173/2; 173/205

(58) Field of Search ..... 227/2, 131, 129; 173/1, 2, 205, 122, 117, 217, 183, 176

(56) References Cited

U.S. PATENT DOCUMENTS

| | | | | | |
|---|---|---|---|---|---|
| 4,298,072 | A | * | 11/1981 | Baker et al. | 173/13 |
| 4,530,454 | A | | 7/1985 | Gloor et al. | |
| 4,572,053 | A | | 2/1986 | Sosnowski et al. | |
| 4,640,452 | A | | 2/1987 | Matt et al. | |
| 4,720,033 | A | | 1/1988 | Olesen | |
| 4,811,885 | A | | 3/1989 | Lai | |
| 4,964,558 | A | * | 10/1990 | Crutcher et al. | 227/8 |
| 5,320,270 | A | * | 6/1994 | Crutcher | 227/131 |
| 5,443,196 | A | | 8/1995 | Burlington | |
| 5,495,161 | A | * | 2/1996 | Hunter | 318/807 |
| 5,511,715 | A | * | 4/1996 | Crutcher et al. | 227/131 |
| 5,927,585 | A | * | 7/1999 | Moorman et al. | 227/132 |
| 6,318,615 | B1 | | 11/2001 | Walter | |
| 6,604,666 | B1 | | 8/2003 | Pedicini et al. | |
| 6,626,348 | B2 | | 9/2003 | Kitamura | |
| 6,669,072 | B2 | * | 12/2003 | Burke et al. | 227/131 |
| 6,705,503 | B1 | | 3/2004 | Pedicini et al. | |
| 6,755,336 | B2 | * | 6/2004 | Harper et al. | 227/129 |
| 6,766,935 | B2 | | 7/2004 | Pedicini et al. | |
| 6,769,593 | B2 | | 8/2004 | Pedicini et al. | |
| 2002/0185514 | A1 | | 12/2002 | Adams et al. | |
| 2003/0066858 | A1 | | 4/2003 | Holgersson | |

* cited by examiner

*Primary Examiner*—Scott A. Smith
(74) *Attorney, Agent, or Firm*—Harness, Dickey & Pierce, P.L.C.

(57) ABSTRACT

A fastening tool that drives a fastener into a work-piece. The tool includes a motor that is connected to a transmission. The transmission includes a flywheel. The tool also includes a driver mechanism that is adapted to drive the fastener into the work-piece. The flywheel is connected to the driver mechanism when the flywheel is in a flywheel firing position. The tool includes a control module that detects a flywheel position and compares the flywheel position to the flywheel firing position. The control module also adjusts the flywheel position based on the comparison. The control module ensures that the transmission has enough rotations to ensure that enough momentum can be generated to drive the fastener into the work-piece.

31 Claims, 11 Drawing Sheets

ELECTRONIC CONTROL OF A CORDLESS FASTENING TOOL

FIELD OF THE INVENTION

The present invention relates to a cordless fastening tool and more specifically to an electronic control module and a related control method for the cordless fastening tool.

BACKGROUND OF THE INVENTION

Traditional fastening tools can employ pneumatic actuation to drive a fastener into a work-piece. In these tools, air pressure from a pneumatic system can be utilized to both drive the fastener into the work-piece and to reset the tool after driving the fastener. It will be appreciated that in the pneumatic system a hose and a compressor are required to accompany the tool. To that end, a combination of the hose, the tool and the compressor provides for a large, heavy and bulky package that is relatively inconvenient and cumbersome to transport.

One alternative to a tool that requires a pneumatic system are tools that employ combustion systems for generating power to drive a fastener into a work-piece. These tools typically hold a combustible propellant and have a battery that is employed to produce a spark for igniting the combustible propellant. Expanding combustion gases are used to drive the fastener. Additional propellant canisters, therefore, must be carried to ensure continued use of the fastening tool. Moreover, the combustion system can exhaust combustion gases in close proximity to the user.

In view of the drawbacks of traditional pneumatically powered fastening tools and fastening tools that employ combustible propellants, battery-powered fastening tools have been developed, such as the DeWalt DC612KA and DC618KA finish nailers. Like the tools that employ combustible propellants, these battery-powered fastening tools can utilize an electronic sensor to detect when a contact trip is pressed against the work-piece. In other examples, the fastening tool can use complex transmissions and powerful motors to drive a fastener without the assistance of combustion or pneumatic power. It will be appreciated that the multiple switches and the complex transmissions along with the more powerful motors required to drive the systems add to the complexity and cost of the cordless fastening tool.

SUMMARY OF THE INVENTION

A fastening tool that drives a fastener into a work-piece. The fastening tool includes a motor that is connected to a transmission. The transmission includes a flywheel. The fastening tool also includes a driver mechanism that is adapted to drive the fastener into the work-piece. The flywheel is connected to the driver mechanism when the flywheel is in a flywheel firing position. The fastening tool further includes a control module that detects a flywheel position and compares the flywheel position to the flywheel firing position. The control module also adjusts the flywheel position based on the comparison.

Further areas of applicability of the present invention will become apparent from the detailed description provided hereinafter. It should be understood that the detailed description and specific examples, while indicating the various embodiment of the invention, are intended for purposes of illustration only and are not intended to limit the scope of the invention.

BRIEF DESCRIPTION OF THE DRAWINGS

The present invention will become more fully understood from the detailed description, the appended claims and the accompanying drawings, wherein:

DETAILED DESCRIPTION OF THE VARIOUS EMBODIMENTS

The following description of the various embodiments is merely exemplary in nature and is in no way intended to limit the invention, its application or uses. As used herein, the term module and/or control module can refer to an application specific integrated circuit (ASIC), an electronic circuit, a processor (shared, dedicated, or group) and memory that executes one or more software or firmware programs, a combinational logic circuit, or other suitable components that provide the described functionality.

Figure 1:
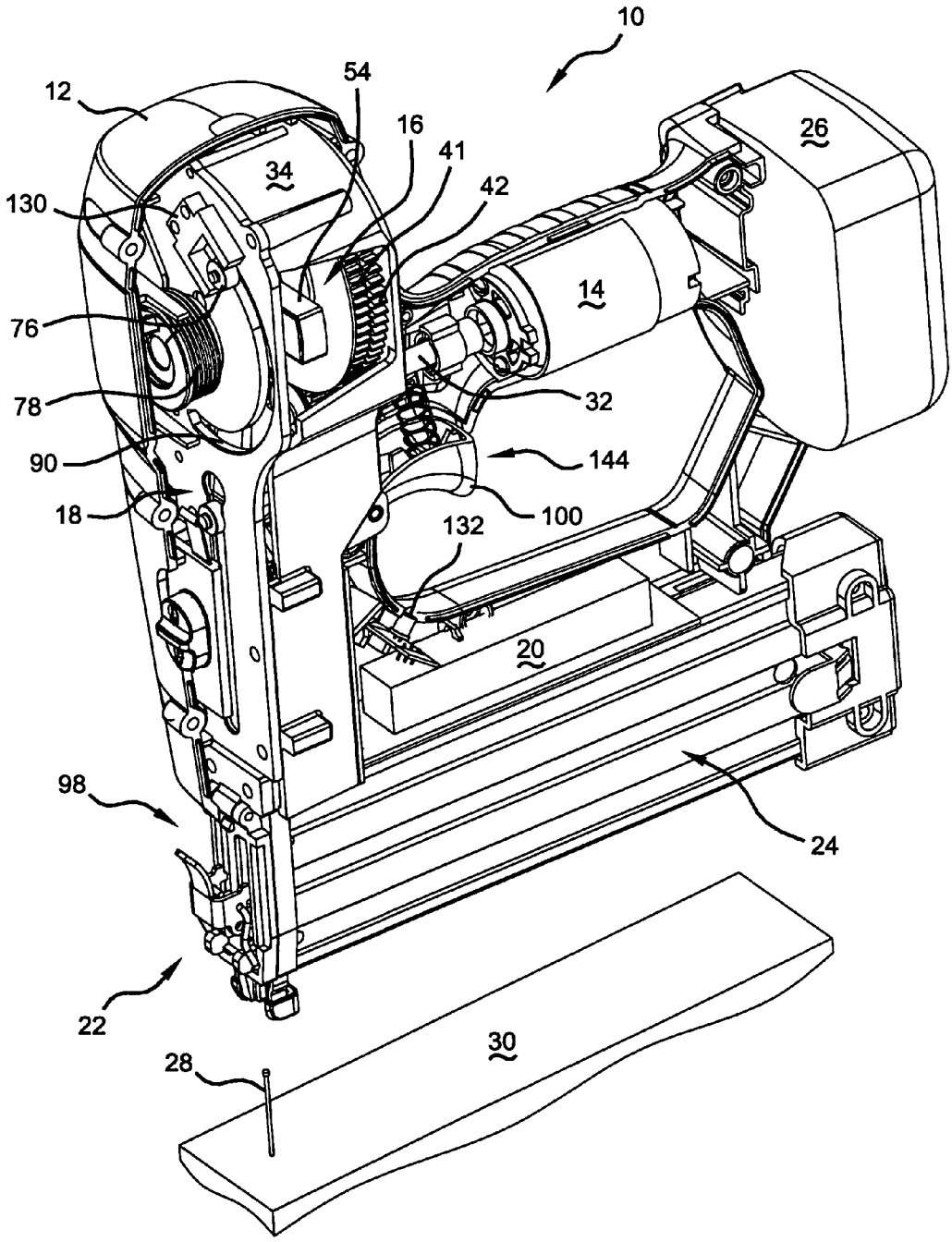
FIG. 1 is a perspective view of an exemplary cordless fastening tool constructed in accordance with the teachings of the present invention showing an exemplary fastener and an exemplary work-piece.

With reference to FIG. 1, an exemplary fastening tool constructed in accordance with the teachings of the present invention is shown and generally indicated by reference numeral 10. The fastening tool 10 can include an exterior housing 12, which can house a motor 14, a transmission 16, a driver mechanism 18 and a control module 20. The fastening tool 10 can also include a nosepiece 22 and a fastener magazine 24 and a battery 26. The fastener magazine 24 can be coupled to the driver mechanism 18, while the battery 26 can be coupled to the exterior housing 12. The motor 14 can drive the transmission 16, which in turn can actuate the driver mechanism 18. Actuation of the driver mechanism 18 can drive fasteners 28, which are sequentially fed from the fastener magazine 24 into the nosepiece 22, into a work-piece 30. The fasteners 28 could be nails, staples, brads, clips or any such suitable fastener that could be driven into the work-piece 30.

Figure 2:
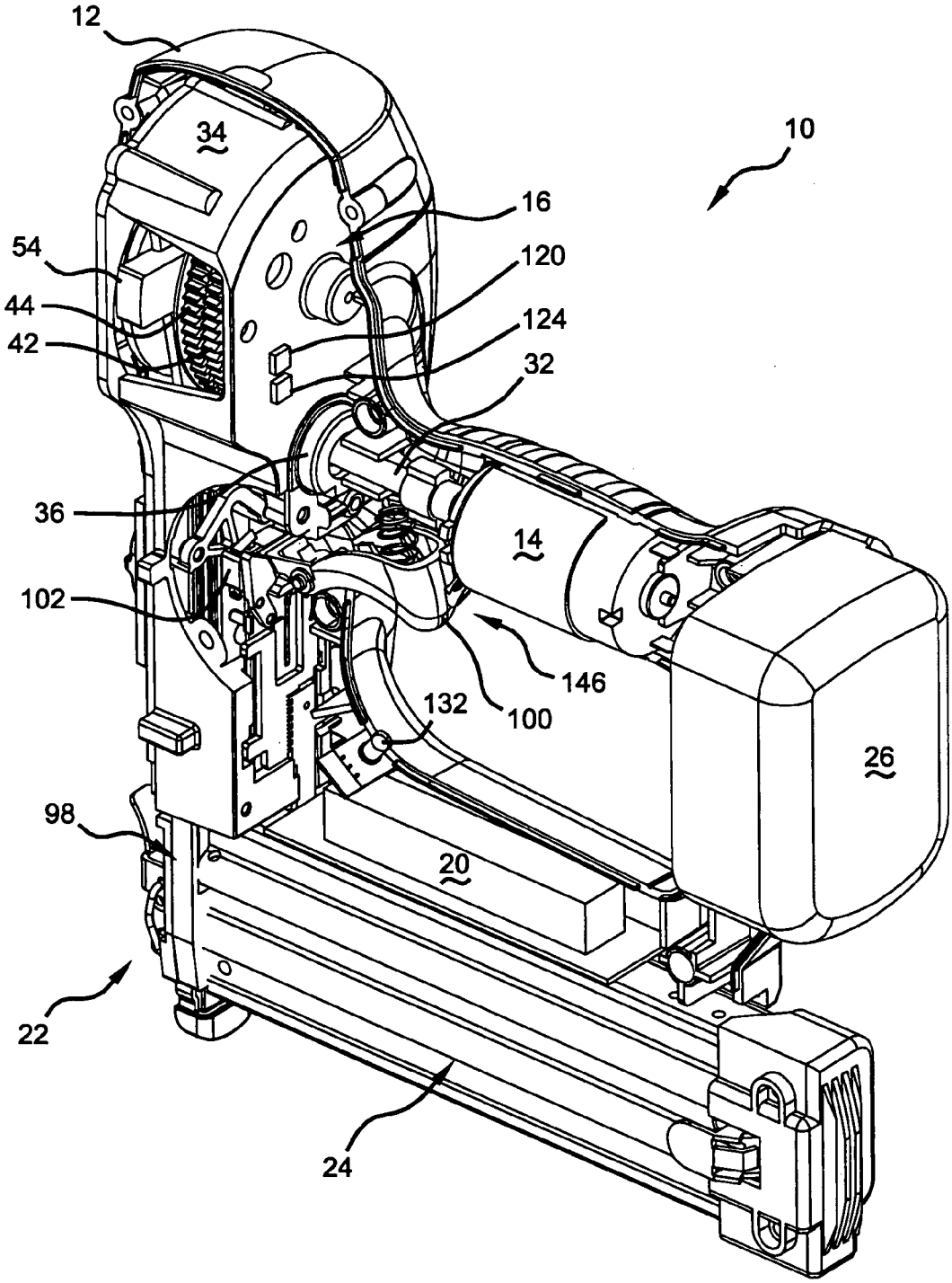
FIG. 2 is similar to FIG. 1 and shows a transmission, a driver mechanism and a control module constructed in accordance with the teaching of the present invention.
Figure 3:
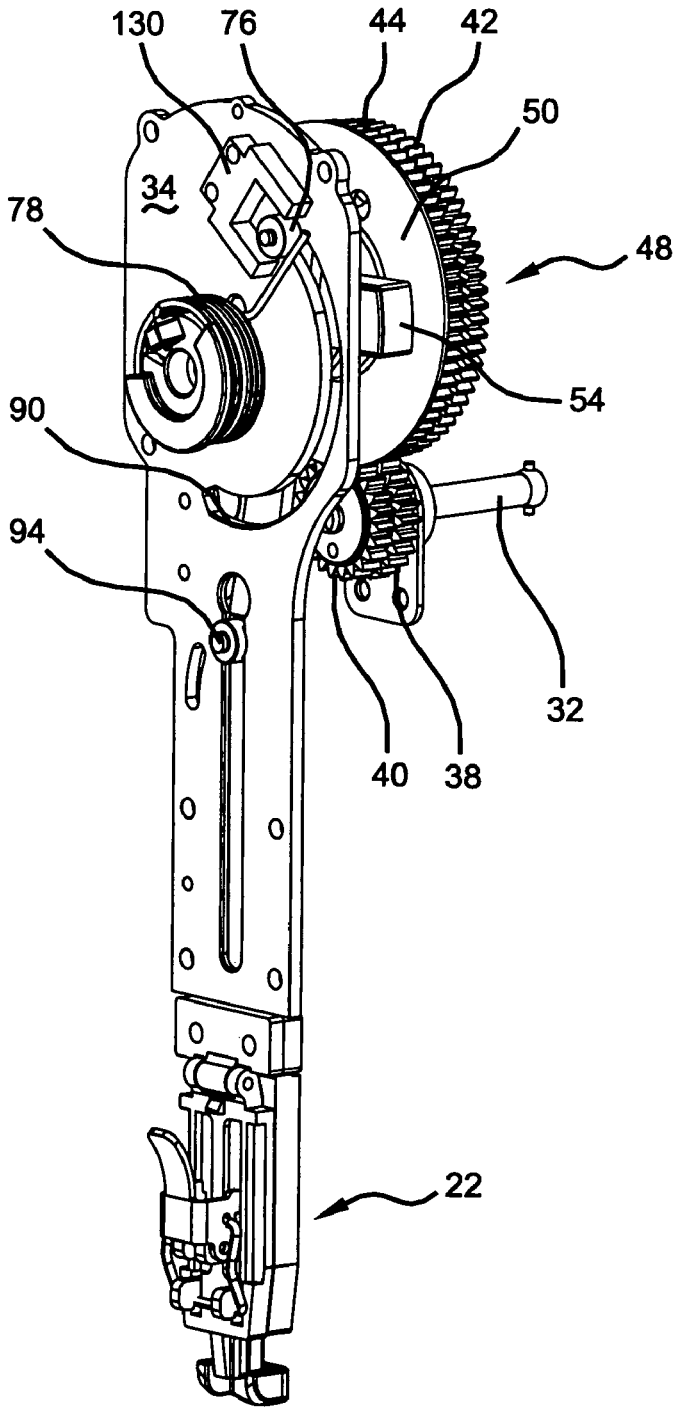
FIG. 3 is a partial perspective view of the fastening tool of FIG. 1 and shows the transmission and the driver mechanism including a crank link track and the crank link return-spring.

With reference to FIG. 2, a driveshaft 32 can connect an input (not specifically shown) of the transmission 16 to an output (not specifically shown) of the motor 14. A transmission housing 34 can encase the transmission 16, a portion of a driveshaft 32 and various components of the transmission 16. A driveshaft bearing 36 can be employed to journally support the driveshaft 32 in the transmission housing 34. With reference to FIGS. 2 and 3, the transmission 16 can include a first drive gear 38 and a second drive gear 40 that can be coupled for rotation with the driveshaft 32 within the transmission housing 34. The first drive gear 38 can be closer to the motor 14 relative to the second drive gear 40. It will be appreciated that the driveshaft 32, the first drive gear 38 and the second drive gear 40 can rotate at the same rotational speed.

Figure 4:
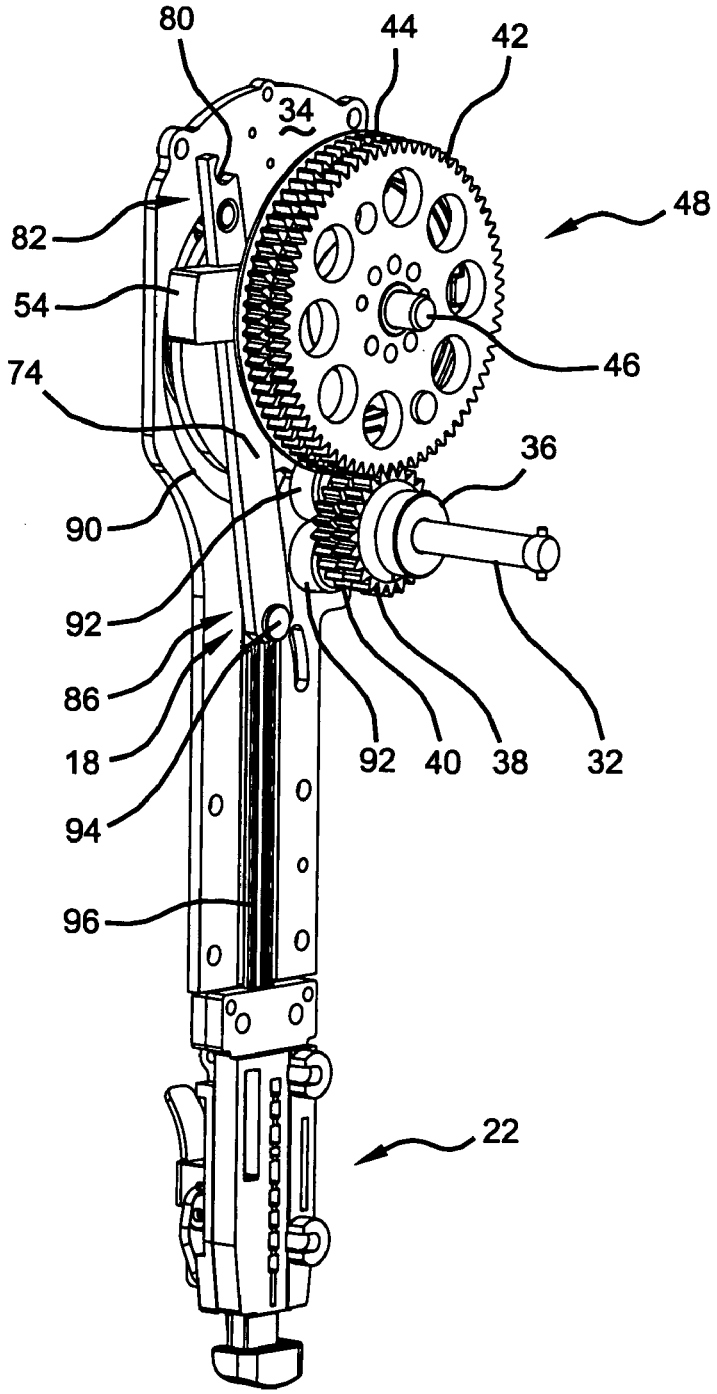
FIG. 4 is a partial perspective view of the fastening tool of FIG. 1 and shows the driver mechanism and the transmission including a flywheel, a cam gear, a first drive gear and a second drive gear.

With reference to FIGS. 3 and 4, the transmission 16 (FIG. 2) can also include a flywheel 42 and a cam gear 44 that can be mounted for rotation on a transmission shaft 46. The first drive gear 38 can meshingly engage and drive the flywheel 42 while the second drive gear 40 can meshingly engage and drive the cam gear 44. The flywheel 42, the cam gear 44, the first drive gear 38 and the second drive gear 40 can form a transmission gear set 48. To that end, each gear of the transmission gear set 48 can be configured (e.g., by pitch diameter and/or by number of teeth) so that the flywheel 42 and the cam gear 44 rotate at different rotational speeds. The flywheel 42, for example, can rotate in response to rotation of the driveshaft 32 at a faster rotational velocity than the cam gear 44.

By way of example, the first drive gear 38 can have twenty-four (24) teeth and the flywheel 42 can have sixty-eight (68) teeth, which provides a gear ratio of 2.83 to 1 between the flywheel 42 and the first drive gear 38. By way of further example, the cam gear 44 can have sixty-nine (69) teeth and the second drive gear 40 can have twenty-three (23) teeth, which provides a 3 to 1 gear ratio between the cam gear 44 and the second drive gear 40. The differing configurations of the gears in the transmission gear set 48 can cause the flywheel 42 and the cam gear 44 to rotate at different rotational velocities for a given speed of the motor 14 and the driveshaft 32. With the above exemplary gear ratios, the flywheel 42 will rotate at a faster rotational velocity than the cam gear 44.

Figure 5:
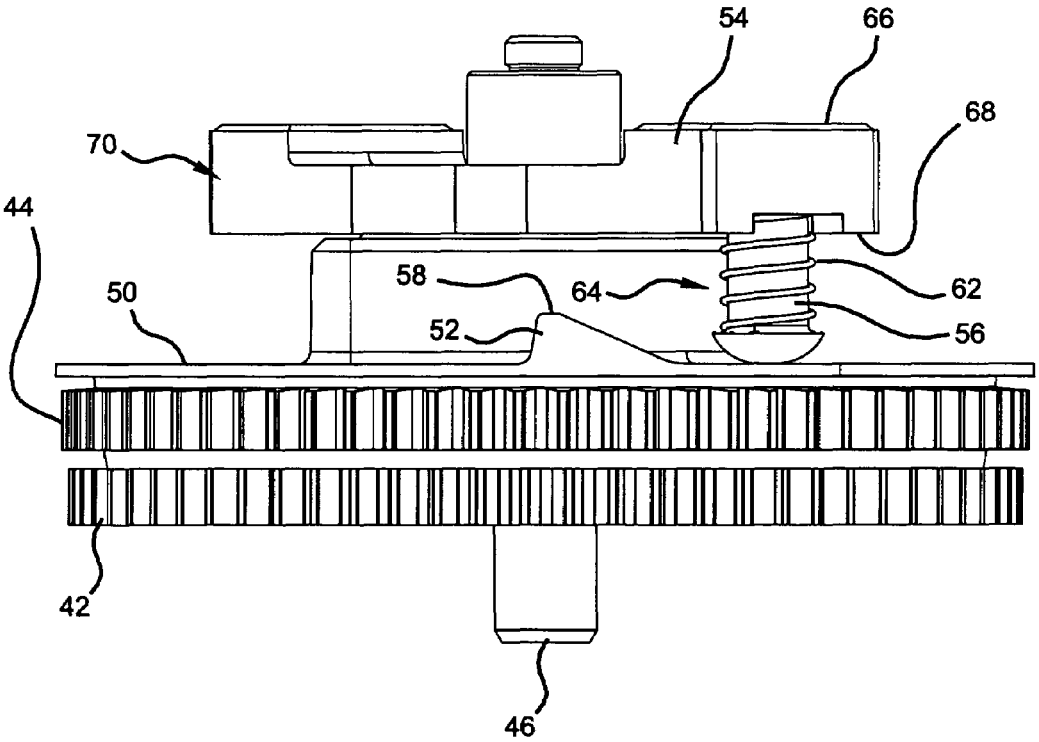
FIG. 5 is a partial front view of the transmission showing the flywheel and the cam gear prior to engagement with a clutch pin.
Figure 6:
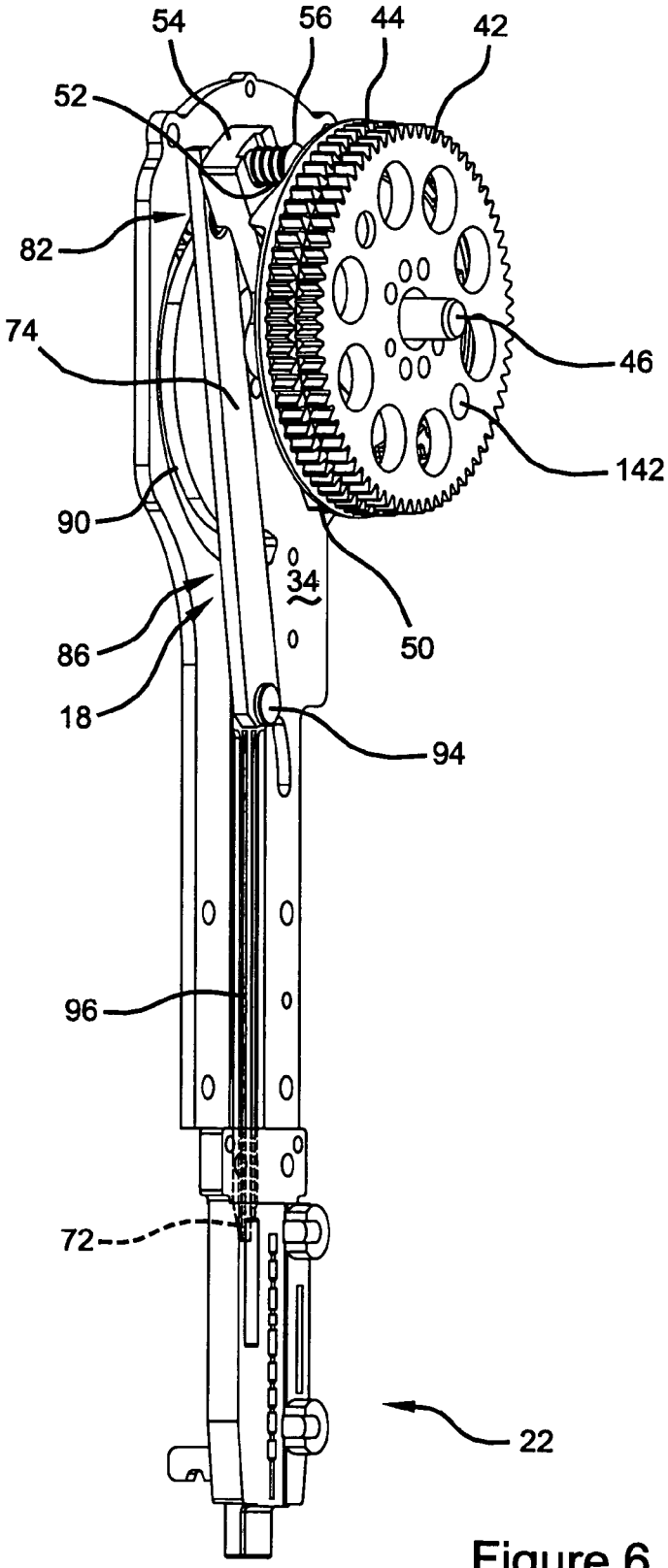
FIG. 6 is similar to FIG. 4 but shows the transmission prior to engagement with the driver mechanism.
Figure 7:
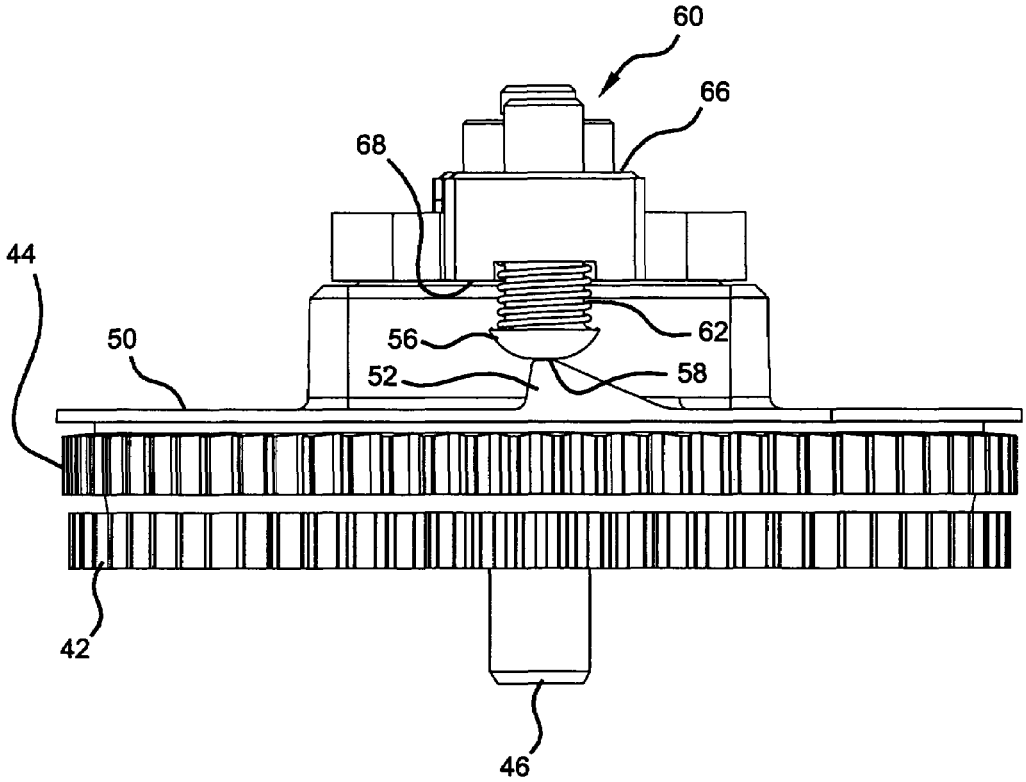
FIG. 7 is similar to FIG. 5 but shows a ramp on the cam gear in contact with the clutch pin.

With reference to FIG. 5 through FIG. 8, the cam gear 44 can include a cover 50 defining a ramp 52. The cover 50 can fixedly connect to the cam gear 44 opposite the flywheel 42. The flywheel 42 can include a clutch arm 54 that can rotate with the remainder of the flywheel 42. The clutch arm 54 can be disposed on a side of the ramp 52 opposite the cam gear 44. The ramp 52 can be configured to engage a clutch pin 56 that is carried by the clutch arm 54, as shown in FIG. 7. For example, rotation of the cam gear 44 at a rotational velocity that is less than that of the flywheel 42 can cause a head 58 of the clutch pin 56 to advance toward or approach the ramp 52, as is illustrated in FIGS. 5 and 7. A clutch pin spring 60 can bias the clutch pin 56 into a retracted or a seated position 62, which is shown in FIG. 5. Contact between the ramp 52 and the clutch pin 56 can cause the clutch pin 56 to travel up the ramp 52 and push the clutch pin 56 outwardly from the clutch arm 54 from the seated position 62 into an extended position 60, as shown in FIG. 7. By way of the above example, the clutch pin 56 will rotate into alignment with and contact the ramp 52 every seventeen (17) rotations.

It will be appreciated that when the clutch pin 56 is in the extended position 60, the clutch pin 56 can extend above a face 66 of the clutch arm 54 in a direction opposite the cover 50. In the seated position 64, the clutch pin 56 can extend below an opposite clutch arm face 68, which can be adjacent to the cover 50. It will also be appreciated that the clutch arm 54 can be counter-balanced such that the clutch pin 56 is radially spaced apart from a center of the transmission shaft 46. The opposite side of the clutch arm 54, which can counter-balance the clutch pin 56 with a suitable weight 70, is distal from the clutch pin 56.

When the clutch pin 56 contacts the ramp 52, the ramp 52 pushes the clutch pin 56 into the extended position 60, as shown in FIG. 7. In the extended position 60, the clutch pin 56 engages the driver mechanism 18. It will be appreciated that the extended position 60 can coincide with placement of the clutch pin 56 along any part of the ramp 52 that permits the clutch pin 56 to extend from the clutch arm 54 by a distance that is sufficient to engage the driver mechanism 18.

The driver mechanism 18 includes a driver blade 72 that connects to a crank link 74. The crank link 74 includes a crank link cam 76 (FIG. 3). The driver mechanism 18 also includes a crank link return-spring 78 (FIG. 3) that can connect to the crank link cam 76. The clutch pin 56 can engage the crank link 74 at a pin catch 80 (FIG. 4) and can drive the crank link 74 from a first position 82 to a second position 84. The motion of the crank link 74, in turn, moves the driver blade 72 from a top position 86 to a bottom position 88. As the fastener 28 in the nosepiece 22 is located in the driver blade's 72 path of travel, the driver blade 72 can insert (i.e., drive) the fastener 28 into the work-piece 30 (FIG. 1) as it travels to the bottom position 88.

When the clutch pin 56 rotates beyond the ramp 52, the clutch pin spring 60 pushes the clutch pin 56 back into the seated position 64. When the clutch pin 56 is no longer engaging the crank link 74, the crank link return-spring 78 (FIG. 3) can return the crank link 74 to the first position 82, as shown in FIG. 6. The crank link cam 76 can be disposed in a link track 90 on the transmission housing 34. The crank link return-spring 78 can urge (bias) the crank link cam 76 along the link track 90 toward the first position 82. When the crank link 74 returns to the first position 82, the fastening tool 10 has completed a driver sequence.

It will be appreciated that the driver sequence can include the clutch pin 56 engaging the pin catch 80 and driving the crank link 74; the driver blade 72 translating from the first and top positions 82, 86 to the second and bottom positions 84, 88; the clutch pin 56 disengaging the pin catch 80; and the crank link return-spring 78 urging the crank link cam 76 upwardly in the link track 90 to cause the crank link 74 and the driver blade 72 to return to the first and top positions 82, 86, which can complete the driver sequence.

Figure 8:
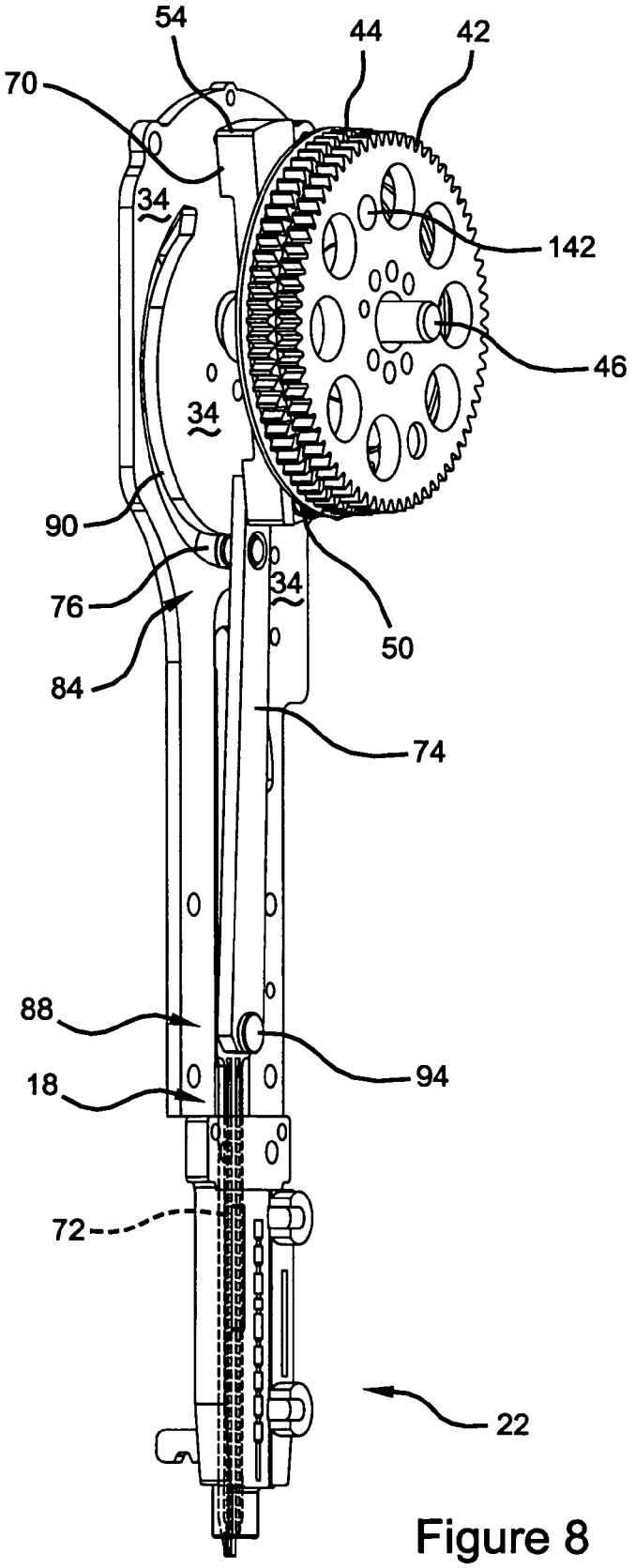
FIG. 8 is similar to FIG. 6 but shows the driver mechanism in bottom dead center position.

With reference to FIGS. 4 and 8, it will be appreciated that the crank link 74 can be configured such that travel beyond the second position 84 can be limited by, for example, one or more resilient bumpers 92. The clutch pin 56 (FIG. 5), therefore, can disengage from the crank link 74 at the bottom position 88. It will also be appreciated that a link joint 94 can pivotally connect the crank link 74 and the driver blade 72. The link joint 94 can allow the crank link 74 to travel in an approximately circular path, while the driver blade 72 travels in a vertical path (i.e., up and down). Moreover, a blade channel 96 can be employed to confine the driver blade 72 for movement along a desired axis to ensure travel in an up and down direction.

With reference to FIG. 1, the nosepiece 22 can connect to the driver mechanism 18 and the fastener magazine 24. The fastener magazine 24 can hold a plurality of the fasteners 28 and sequentially advance each fastener 28 into the nosepiece 22. The driver blade 72 can travel down the blade channel 96 and strike one of the fasteners 28 residing in the blade channel 96 and drive the fastener 28 into the work-piece 30. The nosepiece 22 can include a contact trip mechanism 98. The contact trip mechanism 98 can be configured to prevent the fastening tool 10 from driving the fastener 28 into the work-piece 30 unless the contact trip mechanism 98 is in contact with the work-piece 30 (i.e., in a retracted position). A more detailed disclosure about the contact trip mechanism 98 is outside the scope of this disclosure but is disclosed in more detail in commonly assigned United States Patent Applications filed herewith and entitled Operational Lock and Depth Adjustment for Cordless Nailer, filed Oct. 29, 2004, Ser. No. 10/978,868, and Cordless Nailer Nosepiece with Integrated Contact Trip and Magazine Feed, filed Oct. 29, 2004, Ser. No. 10/978,867, which are both hereby incorporated by reference as if fully set forth herein.

Briefly, the fastening tool 10 can be configured such that a user may not initiate the driver sequence unless the user moves the contact trip mechanism 98 and a trigger 100 into a retracted position. The user can move the contact trip mechanism 98 into the retracted position by, for example, pushing the fastening tool 10 against the work-piece 30.

The contact trip mechanism 98, for example, can be a mechanical linkage between the nosepiece 22 and the trigger 100 (FIG. 2). The trigger 100 can be blocked from contacting a trigger switch 102 (FIG. 2) until the contact trip mechanism 98 is moved into the retracted position. The contact trip mechanism 98, for example, can also include a contact trip switch 104 (FIG. 9) that can generate a contact trip signal 106. By way of the above example, pressing the contact trip mechanism 98 into the work-piece 30 can cause the contact trip switch 104 to generate the contact trip signal 106 that can be transmitted to the control module 20. It will be appreciated that the contact trip switch 104 can be any suitable type of switch or sensor including, but not limited to, a micro-switch.

The motor 14 that can drive the transmission 16 can be any suitable type of motor including, but not limited to, a 12-volt DC motor. It will be appreciated that the motor 14 and an operating voltage of the fastening tool 10 can be configured to use one or more voltages, for example, 12 volts DC, 14.4 volt DC, 18 volts DC or 22 volts DC. In a battery-powered system, a battery "low voltage" condition can be defined as a situation where the output of the battery 26 has decreased to a predetermined voltage. The predetermined voltage can be, for example, 10.5 volts DC for a battery with a nominal voltage of 12 volts DC. The predetermined voltage can also be less than or equal to 90% of the nominal battery voltage.

It will be appreciated that the fastening tool 10 can be configured such that after the fastening tool 10 has driven the fastener 28 into the work-piece 30, the flywheel 42 may continue to rotate due to inertia or because the user has continued to retract the trigger 100. After the flywheel 42 has stopped rotating, the control module 20 can determine the remaining number of rotations of the flywheel 42 before the clutch pin 56 can contact the ramp 52. The control module 20 can determine if the remaining number of flywheel rotations is such that the flywheel 42 will not have sufficient stored energy to drive the fastener.

Figure 10:
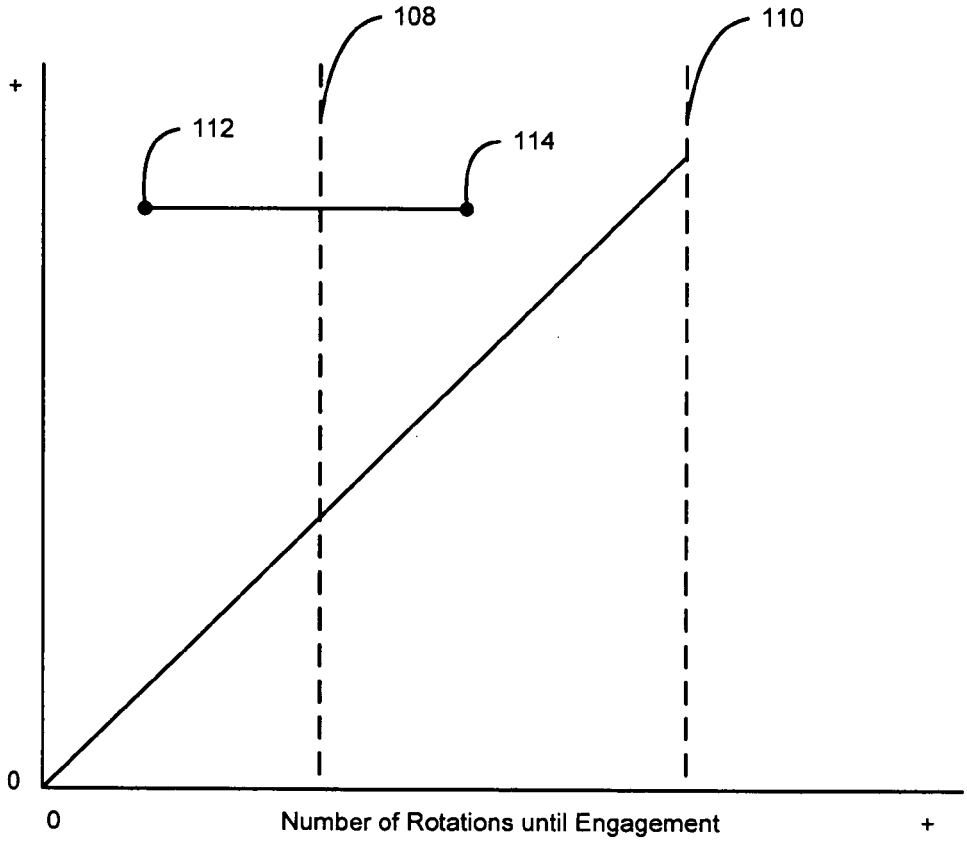
FIG. 10 is a graphical representation of an exemplary relationship between stored energy and the number of remaining rotations of the transmission until engagement with the driver mechanism.

In FIG. 10, for example, if the remaining number of rotations until engagement are such that the remaining number is below (i.e., left of) a minimum line 108, the commensurate amount of energy based on the rotational velocity will be insufficient for the complete driver sequence. If the remaining number of rotations until engagement is between the minimum line 108 and a maximum line 110, the commensurate amount of stored energy will be sufficient. By way of example, the control module 20 can determine that a certain amount of rotations remain until engagement indicated by reference numeral 112. The certain amount of rotations until engagement 112 is less than (i.e., left of) the minimum line 108. The control module 20 can, therefore, cause the motor 14 to reverse the transmission 16 to a reset position, which is indicated by reference number 114. The reset position 114 is between the minimum line 108 and the maximum line 110. When the transmission 16 is positioned at the reset position 114, the transmission 16 can achieve a sufficient rotational velocity to have enough stored energy to drive the fastener 28.

Figure 9:
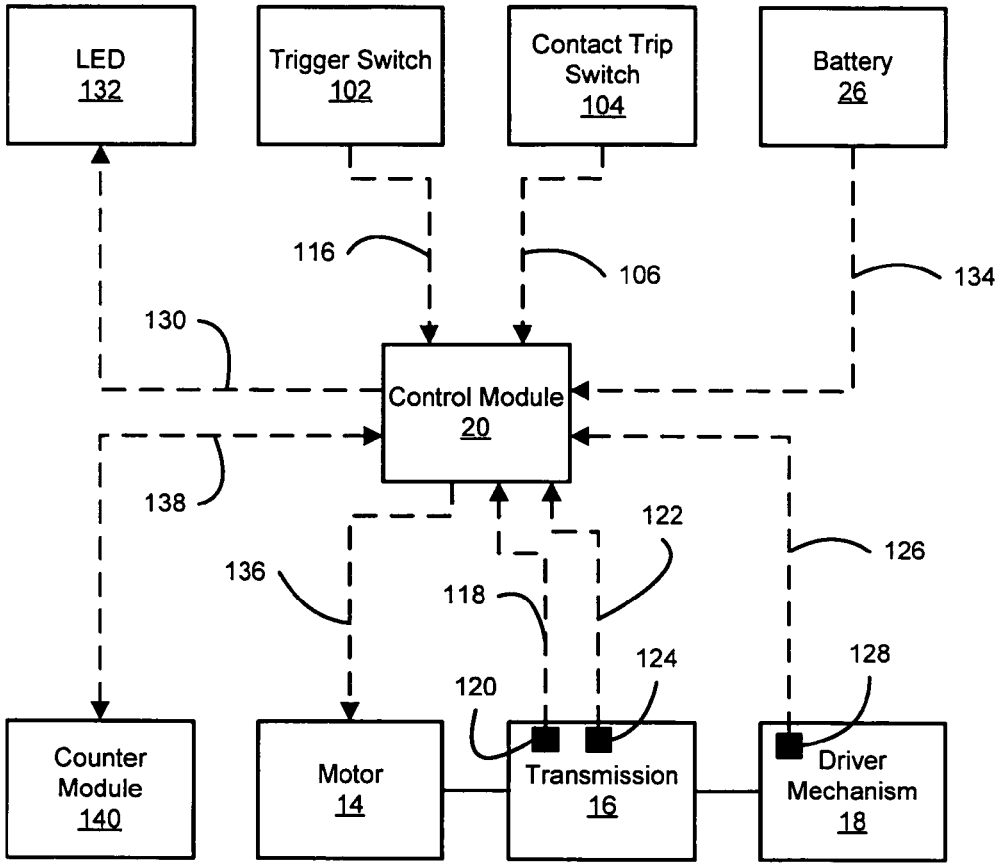
FIG. 9 is a schematic illustration of an exemplary control system constructed in accordance with the teachings of the present invention.

With reference to FIG. 9, the fastening tool 10 can include the control module 20 that can communicate with various components of the fastening tool 10. The control module 20 can receive, for example, a trigger signal 116 from the trigger switch 102, and the contact trip signal 106 from the contact trip switch 104. The control module 20 can also receive a first transmission sensor signal 118 from a first transmission sensor 120, a second transmission sensor signal 122 from a second transmission sensor 124 and a driver mechanism sensor signal 126 from a driver mechanism sensor 128. The control module 20 can also transmit a light emitting diode (LED) signal 130 to a LED 132 (LED). The control module 20 can receive a battery power signal 134 from the battery 26 and monitor the state of the battery 26 based on the battery power signal 134. The control module 20 can also transmit a motor power signal 136 to the motor 14. The control module 20 can further detect a voltage (i.e., an open circuit voltage) at the motor 14, for example, when no current is applied to the motor 14 to determine a rotational velocity of the motor 14 (i.e., open circuit voltage is proportional to rotational velocity). The control module 20 can further transmit and receive a counter signal 138 from a counter module 140.

The transmission sensors 120, 124 can generate transmission signals 118, 122 that permit the control module 20 to determine the position, rotational direction and/or velocity of the flywheel 42. In the various embodiments, the transmission sensors 120, 124 can include Hall-effect sensors. For example, the first sensor 120 can be positioned at a clockwise position relative to the second sensor 124. When a target member 142 is detected by the first sensor 120 and then subsequently by the second sensor 124, the control module 20 can determine that the flywheel 42 is traveling in a counter-clockwise direction, as illustrated in FIG. 2. When the target member 142 is detected by the second sensor 124 and then subsequently by the first sensor 120, the control module 20 can determine that the flywheel 42 is traveling in a clockwise direction, as illustrated in FIG. 2. Moreover, the position of the flywheel 42 can be determined when the target member 142 is over one of the sensors 120, 124.

The speed of the flywheel 42 can also be determined, because the dimension between the first sensor 120 and the second sensor 124, which may be a distance or an angle of rotation, is known (e.g., $\alpha$). The control module 20 can determine the time elapsed between detection by the first sensor 120 and detection by the second sensor 124 (e.g., $t_2-t_1$). Speed between the sensors 120, 124 can then be determined by the control module 20, by dividing the dimension by the time (e.g., $\alpha/(t_2-t_1)$). In addition, the control module 20 can transmit the counter signal 138 to increment a flywheel counter in the counter module 140. The control module 20 can transmit the counter signal 138, when the control module receives one or more transmission sensor signals 118, 122 from the transmission sensors 120, 124, as the target member 142 (i.e., the flywheel 42) rotates past the transmission sensors 120, 124.

The driver mechanism sensor 128 can be mounted on the transmission housing 34 and adjacent to the link track 90. The driver mechanism sensor 128 can be configured to sense a beam of light produced by the driver mechanism sensor 128. It will be appreciated that when the link cam 76 breaks the beam light, the crank link 74 can be in the top dead center position 82. When the beam of light is detected (i.e., the driver mechanism 18 is not in the top dead center position 82), the driver mechanism sensor 128 can transmit the driver mechanism sensor signal 126 to the control module 20. The driver mechanism sensor 128 can be any type of suitable contact sensor such as, but not limited to, a limit switch. The driver mechanism sensor 128 can also be any type of non-contact sensor such as, but not limited to, a proximity switch or an optical sensor.

The control module 20 can determine that the crank link 74 has returned to the top dead center position 82, based on the driver mechanism sensor signal 126. More specifically, when the crank link cam 76 breaks the beam of light, the control module can determine that the driver mechanism 18 has returned to the top dead center position 82. When the driver mechanism 18 returns to the top dead center position 82, the control module can determine that the fastening tool 10 has completed the driver sequence.

When the driver mechanism 18 is moved from the top dead center position 82, the driver mechanism sensor 128 can detect the beam of light and can transmit the driver mechanism sensor signal 126. When the control module 20 receives the driver mechanism sensor signal 126, the control module 20 can transmit the counter signal 138 to reset a flywheel rotation counter to zero in the counter module 140. When the transmission sensors 120, 124 detect the target member 142, transmission sensors 120, 124 can transmit the transmission sensor signals 118, 122. When the control module 20 receives the transmission sensor signals 118, 122 after resetting the flywheel counter to zero, the control module 20 can transmit the counter signal 138 to reset the flywheel rotation counter in the counter module 140 to the maximum number of flywheel rotations. By way of the above example, the maximum number of flywheel rotations is seventeen. Each time the target member 142 passes the transmission sensors 120, 124, the transmission sensors 120, 124 can transmit the transmission sensor signals 118, 122. When the control module 20 receives the transmission sensor signals 118, 122, the control module 20 can transmit the counter signal 138 to increment the flywheel rotation counter in the counter module 140. By way of the above example, each pass of the target member 142 decreases the flywheel counter by one, thereby indicating one less flywheel rotation before the clutch pin 56 (FIG. 5) engages the pin catch 80 (FIG. 4).

The control module 20 can also determine that the crank link 74 (FIG. 4) has failed to return to the top dead center position 82, based on the driver mechanism sensor signal 126. More specifically, when the crank link cam 76 fails to break the beam of light, the control module 20 can determine that the crank link 74 has not returned to the top dead center position 82, which can indicate that the fastening tool 10 may be in a jammed condition. The jammed condition may result from, for example, an object obstructing the path of travel of the transmission 16 or the driver mechanism 18.

The trigger 100 mounts to the transmission housing 34 and extends through the exterior housing 34. The trigger 100 is biased into an extended position 144. The trigger 100 can be moved into a retracted position 146. When the trigger 100 is in the retracted position 146, the trigger 100 can interact with the trigger switch 102 and can cause the trigger switch 102 to generate a trigger signal 116. In the retracted position 146, the trigger 100 can activate the trigger switch 102. In contrast, the trigger 100 will not activate the trigger switch 102 in the extended position 144. By way of the above example, the trigger 100 cannot activate the trigger switch 102, unless the contact trip mechanism 98 is retracted. In the various configurations, the trigger switch 102 can be any suitable type of switch including, but not limited to, a micro switch.

Figure 11:
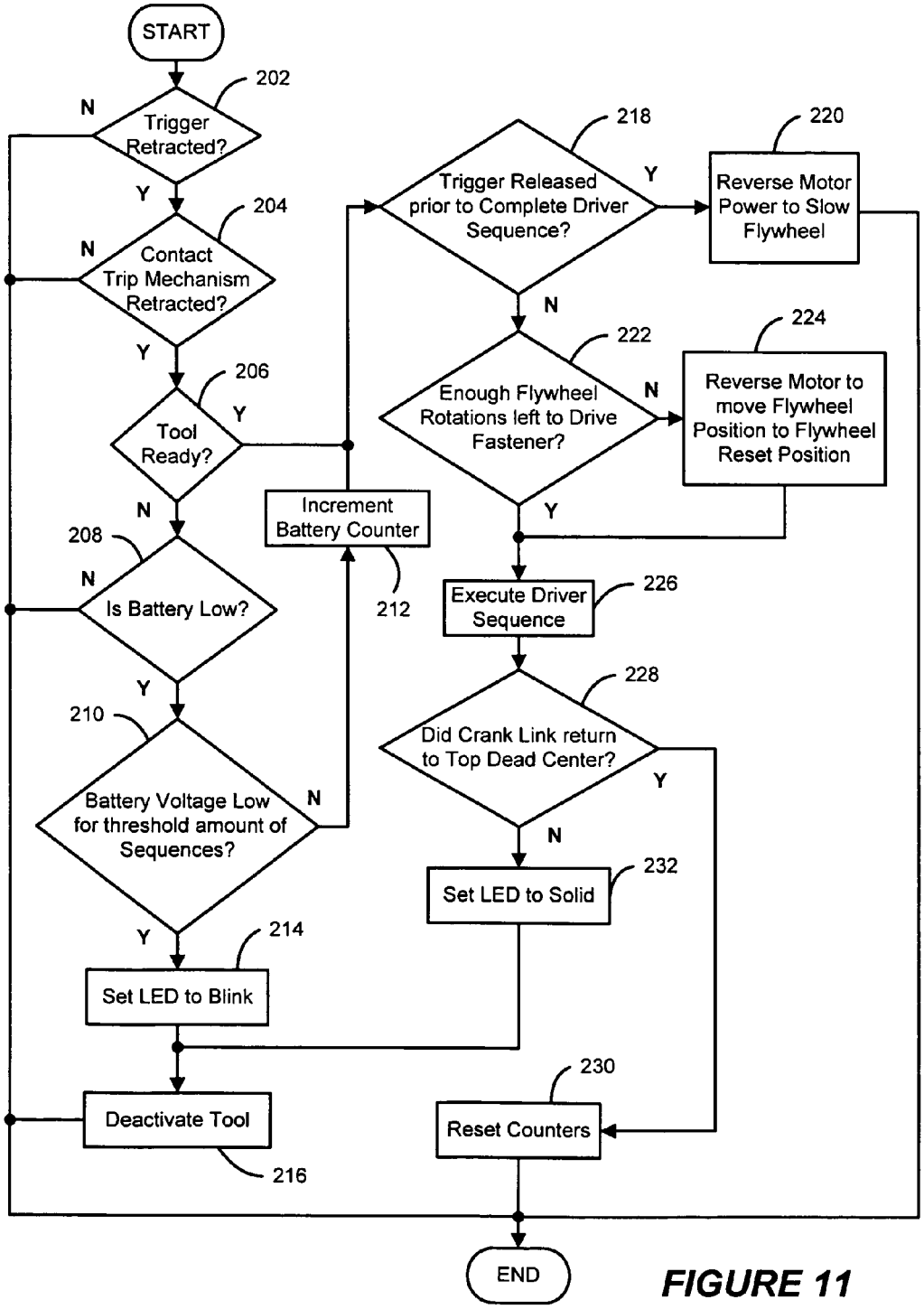
FIG. 11 is a flow chart illustrating exemplary steps executed by the exemplary control system of the present invention.

With reference to FIG. 11, a flowchart is shown that illustrates an exemplary control sequence 200 for the fastening tool 10 (FIG. 1). In step 202, control determines whether the trigger 100 has been retracted. When control determines that the trigger 100 has been retracted, control continues in step 204. When control determines that the trigger 100 has not been retracted, control ends. It will be appreciated that when the trigger 100 is retracted, the trigger is moved into the retracted position 146 and can make contact with the trigger switch 102, as shown in FIG. 2. Contact with the trigger switch 102 can cause the trigger switch 102 to transmit the trigger switch signal 116 to the control module 20, which can indicate that the trigger 100 has been retracted.

In step 204, control determines whether the contact trip mechanism 98 is retracted. It will be appreciated that in various configurations the contact trip mechanism 98 can include a mechanical linkage and thus omit the contact trip switch 104 (FIG. 9). When the contact trip switch 104 is omitted, control will omit step 204. With the contact trip switch 104 omitted, the mechanical linkage can disable the trigger 100 when the contact trip mechanism 98 is retracted. When the contact trip switch 104 is included, the contact trip switch 104 can transmit the contact trip switch signal 106 to the control module 20 when the contact trip mechanism 98 is engaged. When control determines that the contact trip mechanism 98 is retracted, control continues in step 206. When control determines that the contact trip mechanism is not retracted, control ends. When the contact trip mechanism 98 does not include the contact trip switch 104 (i.e., when the contact trip mechanism is purely mechanical), control omits step 204 and control continues with step 206.

In step 206, control determines whether the fastening tool 10 (FIG. 1) is ready. The fastening tool 10 is not ready, when control determines that the fastening tool 10, for example, has a low battery or is jammed. Moreover, the fastening tool 10 is not ready when the control module 20 has deactivated the fastening tool 10. When control determines that the fastening tool 10 is ready, control continues with step 218. When control determines that the fastening tool 10 is not ready, control continues with step 208.

In step 208, control determines if the voltage of the battery 26 (FIG. 1) is low. Control can determine that the voltage of the battery 26 is low when the control module 20 detects, for example, that battery voltage has dropped below a threshold level. The threshold level can, for example, be 90% of nominal voltage (e.g., about 10.5 volts in 12-volt system). When control determines that the battery voltage is not low, control ends, as the fastening tool 10 may not be ready for reasons such as, but not limited to, a jammed condition or the fastening tool has been deactivated. When control determines that the battery voltage is low, control continues with step 210.

In step 210, control determines whether the battery voltage has been low for a threshold amount of driver sequences. For example, control can determine whether the battery voltage has been below about 10.5 volts for at least three driver sequences. It will be appreciated that the amount of sequences, the low voltage threshold level and whether the driver sequences need to be consecutive can depend on the specific fastening tool model. When control determines that the battery voltage has been low for the threshold amount of driver sequences, control continues with 214. When control determines that battery voltage has not been low for the threshold amount of the driver sequences, control continues with step 212.

In step 214, control sets the LED to illuminate in a solid fashion. The illuminated LED can indicate to the user that the voltage of the battery 26 (FIG. 1) is low and the battery 26 may need to be charged. In step 216, control deactivates the fastening tool 10. Deactivation of the fastening tool 10 can prevent the user from drawing the battery voltage too low and/or executing the driver sequence with too little battery power available. After step 216, control ends. In step 212, control can increment a driver sequence counter in the counter module 140 (FIG. 9) that can be used to determine how many driver sequences have occurred while the battery 26 is below the threshold voltage. From step 212, control continues with step 218.

In step 218, control determines whether the trigger 100 (FIG. 1) was released prior to completion of the driver sequence. It will be appreciated that the driver sequence includes the driver mechanism 18 moving from the top dead center position 82, 86 to the bottom dead center position 84, 88 and then back to the top dead center position 82, 86. When control determines that the trigger 100 was released prior to completion of the driver sequence, control continues in step 220. When control determines that the trigger was not released prior to completion of the driver sequence, control continues with step 222.

In step 220, control can reverse power to the motor 14 to slow the transmission 16 and bring it to a stop. It will be appreciated that the power signal 136 to the motor 14 can be stopped, which can cause the motor 14 to slow on its own friction. It will also be appreciated that the polarity of the power signal 136 to the motor 14 can be reversed but no current can be applied, which can cause dynamic braking of the motor 14 also referred to as electric braking. It can further be appreciated that the control module 20 can configure the power signal 136 to reverse the motor 14 (i.e., reversed polarity with application of a current) and thereby slow the motor 14 faster than dynamic braking and slowing on its own friction. After step 220, control ends.

In step 222, control determines whether enough flywheel rotations remain to adequately drive the fastener 28. It will be appreciated that the remaining amount of rotations of the flywheel 42 can be proportional to a rotational velocity that can be achieved by the flywheel 42. For example, when the flywheel 42 has less than the threshold amount of rotations remaining before the clutch pin 56 engages the driver mechanism 18, the flywheel 42 cannot achieve an adequate amount of rotational velocity, thus not enough momentum and therefore will not have enough stored energy to adequately drive the fastener 28 into the work-piece 30.

By way of the above example, the flywheel 42 needs to rotate at least seven times to achieve enough rotational velocity. It will be appreciated that rotational velocity required to drive the fastener 28 can be related to varying amounts of flywheel rotations, which can depend on the specific model of the fastening tool 10. In other examples, the rotational velocity of the motor 14 can be adjusted so that less flywheel rotations (i.e., less than seven) are required to complete the driver sequence. For example, the rotational velocity of the motor 14 can be increased such that the rotational velocity achieved by the motor 14 is sufficient to complete the driver sequence with only three flywheel rotations. It will also be appreciated that the rotational velocity of the motor 14 and the commensurate amount of minimum rotations can be specific to certain models of the fastening tool 10.

It will also be appreciated rotational velocity can be determined by monitoring the motor 14. More specifically, the rotational velocity of the motor 14 (FIG. 9) can be determined by briefly (e.g., less then one millisecond) interrupting current to the motor 14 and detecting the voltage (e.g., an open circuit voltage) across the motor 14. The voltage across the motor 14 can be proportional to rotational velocity of the motor 14, which is proportional to the rotational velocity of the flywheel 42. In addition, control can determine the amount of rotational velocity than can be achieved based on the remaining amount of flywheel rotations. When control determines that there are not enough flywheel rotations left and/or not enough rotational velocity to drive the fastener 28, control continues with step 224. When control determines that there are enough flywheel rotations left and/or enough rotational velocity to drive the fastener 28, control continues with step 226.

In step 224, control reverses the transmission 16 to move the flywheel 42 to the reset position. It will be appreciated that the reversing of the flywheel 42 to the reset position will provide at least the minimum amount of flywheel rotations to produce enough momentum to drive the fastener 28 through the work-piece 30. For example, the minimum amount of flywheel rotations can be seven rotations. The reset position, for example, can correspond to at least seven rotations before the flywheel 42 engages the driver mechanism 18. In another example, the reset position can correspond to a position that allows the flywheel 42 twelve rotations before the flywheel 42 engages the driver mechanism 18. In other examples, the reset position can correspond to a position that allows the flywheel 42 seventeen rotations before the flywheel 42 engages the driver mechanism 18. It will be appreciated that the reset position is always greater than or equal to the minimum amount of flywheel rotations required to drive the fastener 28 into the workpiece 30.

In step 226, control executes the driver sequence. The driver sequence includes the clutch pin 56 engaging the crank link 74 at the pin catch 80 and driving the crank link 74 from the top dead center position 82 to the bottom dead center position 84. The motion of the crank link 74, in turn, moves the driver blade 72 from the top dead center position 86 to the bottom dead center position 88. At the bottom dead center position 88, the driver blade 72 can insert the fastener 28 into the work-piece 30. The clutch pin 56 can then rotate beyond the ramp 52 and the clutch pin 56 is pushed back into the seated position 64 by the clutch pin spring 62. The crank link return-spring 78 returns the crank link 74 to the top dead center position 82.

In step 228, control determines whether the crank link 74 has returned to the top dead center position 82. When control determines that the crank link 74 did return to the top dead center position 82, control continues with step 230. When control determines that the crank link 74 did not return to the top dead center position 82, control continues with step 232. In step 230, control resets the flywheel rotation counter in the counter module 140 because the fastening tool 10 has completed the driver sequence. The flywheel rotation counter, for example, counts the amount flywheel rotations to ensure the flywheel 42 has enough momentum to drive the fastener 28. After step 230, control ends. In step 232, control sets the LED to illuminate in a blinking fashion compared to step 208 where the LED has the solid illumination. The blinking LED can indicate to the user that the fastening tool is jammed. From step 232, control continues with step 216. In step 216 as above-explained, control deactivates the fastening tool 10 and then control ends. It will be appreciated that the fastening tool should not be used when there is a jammed condition and, as such, control suspends use of the fastening tool when it is jammed.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, the specification and the following claims.

What is claimed is:

1. A method for controlling a fastening tool comprising:

providing a transmission having a flywheel and a driver mechanism, said transmission configured to couple said flywheel to said driver mechanism one time in a driver sequence to cause energy to be transferred from said flywheel to said driver mechanism, said driver sequence including a predetermined number of flywheel rotations in a predetermined rotational direction;

determining a remaining number of said flywheel rotations in said predetermined rotational direction until an end of said driver sequence; and adjusting a position of said flywheel in said driver sequence based on said remaining number of said flywheel rotations.

2. The method of claim 1, wherein said position of said flywheel in said driver sequence is moved to a location when a remaining number of flywheel rotations in said predetermined rotational direction is less than a minimum number of said flywheel rotations.

3. The method of claim 2, wherein said minimum number of said flywheel rotations is about seven.

4. The method of claim 1 further comprising detecting a trigger release event.

5. The method of claim 4 further comprising reversing power to a motor to slow said motor and said flywheel when said trigger release event occurs prior to completion of said driver sequence.

6. The method of claim 1 further comprising driving a fastener when said flywheel connects to said transmission.

7. The method of claim 1 further comprising detecting said driver mechanism in a top dead center position.

8. The method of claim 7 further comprising deactivating the fastening tool when said driver mechanism fails to return to said top dead center position.

9. The method of claim 1 further comprising detecting a battery voltage.

10. The method of claim 9 further comprising deactivating the fastening tool when said battery voltage is one of less than and equal to a threshold level.

11. The method of claim 10 wherein said threshold level is about ninety percent of a nominal battery voltage.

12. The method of claim 1 further comprising determining a rotational velocity of said flywheel based on said remaining number of flywheel rotations.

13. A method for controlling a fastening tool comprising:

providing a transmission having a flywheel and a driver mechanism, said transmission configured to couple said flywheel to said driver mechanism one time in a driver sequence to cause energy to be transferred from said flywheel to said driver mechanism;

determining an achievable rotational velocity of said flywheel based on a remaining number of flywheel rotations until an end of said driver sequence; and adjusting a position of said flywheel in said driver sequence based on said achievable rotational velocity.

14. A method for controlling a fastening tool, the method comprising:

comparing a position of a transmission and a firing position of said transmission;

adjusting said position of said transmission to a reset position based on said comparison;

rotating said transmissions to connect to a driver mechanism; and driving a fastener when said transmission connects to said driver mechanism.

15. The method of claim 14 wherein comparing said position and said firing position of said transmission includes determining a difference between said position and said firing position of said transmission.

16. The method of claim 15 wherein adjusting said position of said transmission to said reset position based on said comparison includes reversing said transmission to said transmission reset position when said difference between said position and said firing position of said transmission is less than a predetermined amount of transmission rotations.

17. The method of claim 16 wherein said predetermined amount of transmission rotations is about seven.

18. The method of claim 14 further comprising reversing power to a motor to slow said motor and said transmission when a trigger release event occurs prior to completion of a complete driver sequence.

19. A fastening tool that drives a fastener into a work-piece, the tool comprising:

a motor connected to a transmission, said transmission includes a flywheel;

a driver mechanism that is adapted to drive the fastener into the work-piece; said flywheel connects to said driver mechanism when said flywheel is in a flywheel firing position; and a control module that detects a flywheel position, that compares said flywheel position to said flywheel firing position, and that adjusts said flywheel position based on said comparison.

20. The fastening tool of claim 19 wherein said control module determines a difference between said flywheel position and said flywheel firing position.

21. The fastening tool of claim 20 wherein said control module adjusts said flywheel position to a flywheel reset position when said difference is less than a predetermined amount of flywheel rotations.

22. The fastening tool of claim 21 wherein said predetermined amount of flywheel rotations is about seven.

23. The fastening tool of claim 19 further comprising a trigger having an activated position and a released position.

24. The fastening tool of claim 19 wherein said control module detects a trigger release event.

25. The fastening tool of claim 24 wherein said control module reverses said motor to slow said motor when said control module detects said trigger release event prior to completion of a driver sequence.

26. The fastening tool of claim 19 wherein said control module detects said driver mechanism in a top dead center position.

27. The fastening tool of claim 26 wherein said control module deactivates the fastening tool when said driver mechanism fails to return to said top dead center position.

28. The fastening tool of claim 27 wherein said control module reverses said motor to slow said motor when said control module detects said trigger release event prior to detecting said driver mechanism in said top dead center position.

29. The fastening tool of claim 19 wherein said control module detects a battery voltage.

30. The fastening tool of claim 29 wherein said control module deactivates the fastening tool when said battery voltage is below a threshold level.

31. The fastening tool of claim 30 wherein said threshold level is about one of less than and equal to about 90% of a nominal battery voltage.

* * * * *